US006911625B2

(12) United States Patent
Shimonaka

(10) Patent No.: US 6,911,625 B2
(45) Date of Patent: Jun. 28, 2005

(54) HEATING ROLLER

(75) Inventor: Masatoshi Shimonaka, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/682,956

(22) Filed: Oct. 14, 2003

(65) Prior Publication Data

US 2004/0089647 A1 May 13, 2004

(30) Foreign Application Priority Data

Oct. 15, 2002 (JP) ..... 2002-300150

(51) Int. Cl.[7] ..... G03G 15/20
(52) U.S. Cl. ..... 219/216; 219/470
(58) Field of Search ..... 219/216, 494, 219/469–471; 399/330–332

(56) References Cited

U.S. PATENT DOCUMENTS 3,398,259 A * 8/1968 Tregay et al. ..... 219/216
4,967,237 A * 10/1990 Sasaki et al. ..... 219/216
5,049,726 A * 9/1991 Higgins et al. ..... 219/462.1
5,700,994 A * 12/1997 Gheer et al. ..... 219/216
6,118,106 A * 9/2000 Scott ..... 219/494
2002/0061199 A1 * 5/2002 Horobin et al. ..... 219/469

FOREIGN PATENT DOCUMENTS

JP 2002-15848 A1 1/2002
JP 2002-258646 A1 9/2002

* cited by examiner

*Primary Examiner*—Teresa J. Walberg
(74) *Attorney, Agent, or Firm*—Rader, Fishman & Grauer PLLC

(57) ABSTRACT

A heating roller has a first heater lamp having a first filament made of tungsten, and a second heater lamp having a second filament wherein the second filament is a heating element whose resistivity value is greater than that of tungsten at a room temperature.

18 Claims, 4 Drawing Sheets

FIG. 1
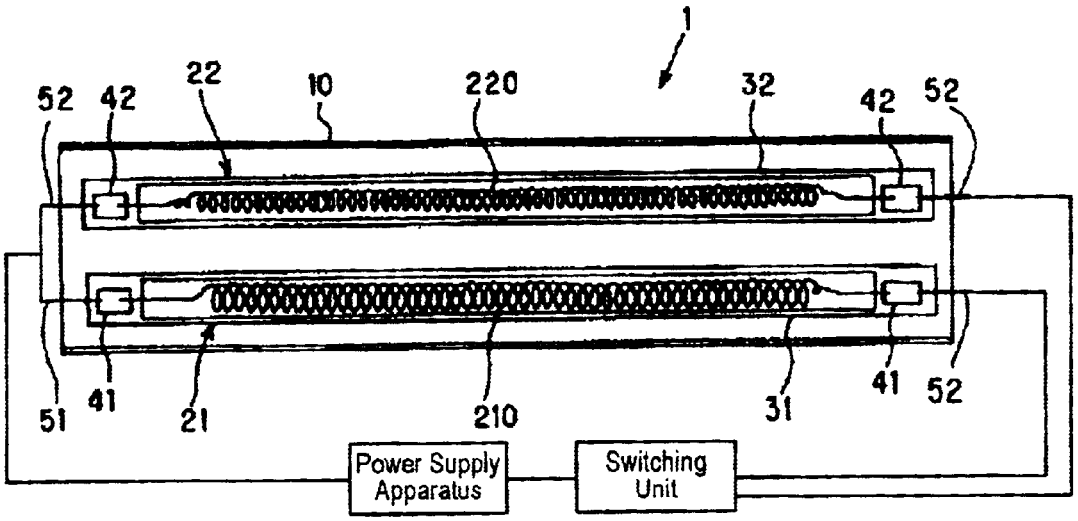
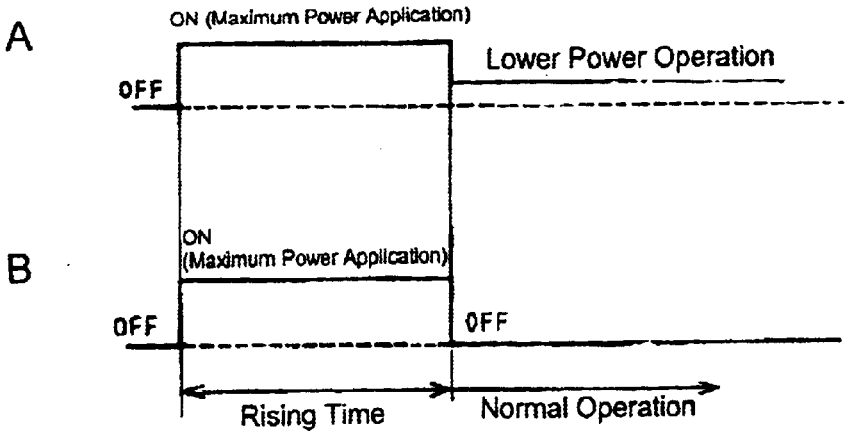
FIG. 2

FIG. 5
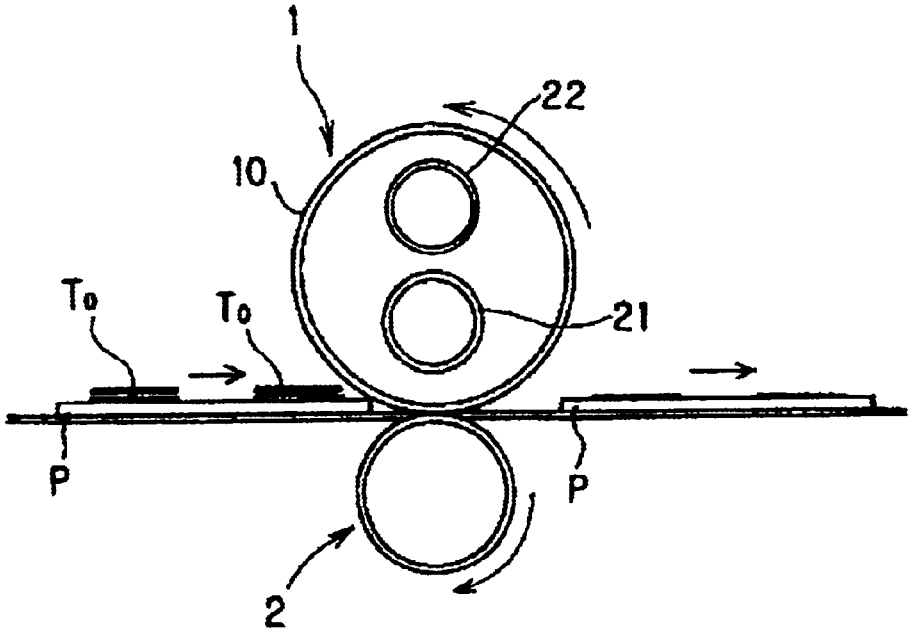
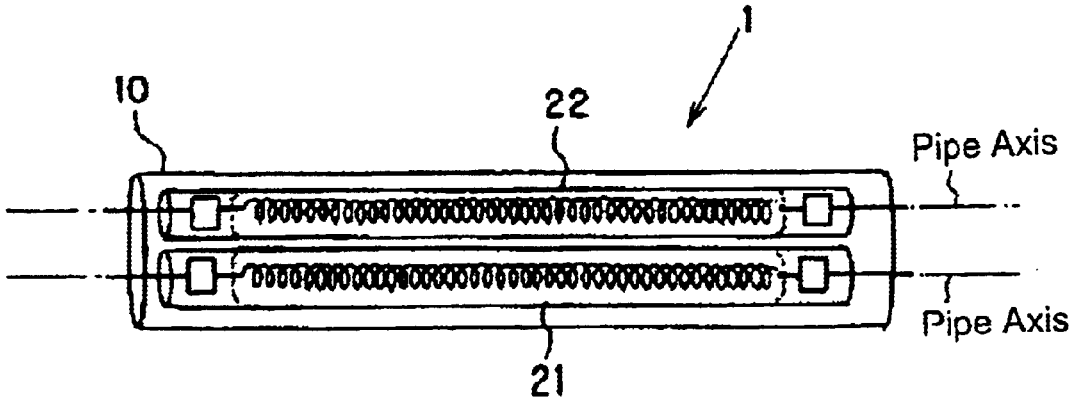
FIG. 6

HEATING ROLLER

TECHNICAL FIELD OF THE INVENTION

The present invention relates to a heater apparatus for a heating roller of a fixing device provided in an image forming apparatus such as an electrophotographic type printer, copying machine and the like.

DESCRIPTION OF RELATED ART

In an image forming apparatus such as a printer, a copying machine and the like that uses an electrophotographic process, a fixing device for fixing a unfixed toner image held on a recording material such as a recording paper sheet, an OHP sheet and the like is provided. For the fixing device, a so-called heating roller is widely used as means for fixing the toner on the paper sheet.

Such a heating roller type fixing device will be explained below, referring to FIG. 5.

In FIG. 5, the fixing device has a heating roller 1 with which a pressure roller 2 is in contact under pressure. A recording paper sheet P, that is, a toner transferred material holding a unfixed toner image $T_o$ passes through a contact area between the heating roller 1 and the pressure roller 2 so that the toner on the recording paper sheet P is fixed by the heat and pressure.

As shown in FIGS. 5 and 6, for example, two heating lamps are provided inside a cylindrical roller body 10 of the heating roller 1, which is made of metal or aluminum so that the tube axis directions of the lamps are in parallel to each other. These two heater lamps are, for example, a fixing heater lamp 21 and an auxiliary heater lamp 22 which are filament lamps in which necessary inert gas and halogen gas are included. Tungsten is used as a material of the filaments in such a heater lamp. The tungsten in which about 50–90 ppm potassium is doped, that is, so called doped tungsten, consists of more than 99.9% tungsten. Such a heater lamp in which the tungsten filaments are used as heating elements has excellent heat response capability and heat-impact resistance capability. As a result, it is possible to obtain an excellent heating roller for the fixing device.

Out of the heaters, the fixing heater lamp 21 operates solely as a heat source for heating the heating roller 1 when fixing the unfixed toner $T_o$ on the recording paper sheet P.

On the other hand, the auxiliary heater lamp 22 is a auxiliary heat source which is turned on only in an initial operation of the fixing device to shorten period to reach a predetermined temperature of the roller body 10, that is, to shorten a rising time of the heating roller.

SUMMARY OF THE INVENTION

However, the heat apparatuses having such a structure have problems described below.

Since the filament of the heater lamp is made of tungsten, rush current which is more than 10 times the amount of current in the steady state flows at the same time voltage from a power supply is applied to the heater lamp instantaneously. The resistivity value of the tungsten at the target temperature of the heart roller (160° C.) is thirteen to sixteen times the value of that at room temperature. Since the tungsten filaments of the heater lamps have such a characteristic, the resistivity value of the tungsten filaments changes due to temperature change.

In view of the above problems, the heater lamp may be turned on by saving power to be applied thereto. However, it takes long time to reach a predetermined temperature of the heating roller since output of the heater lamp is not sufficient. That is, a long rising time of heating roller is necessary. Since a controlling circuit for reducing rush current needs to be provided in the power supply device, the cost of the power supply device increases and the power supply device also grows in size.

In the heater lamp of the fixing device, there is a problem that the circuit of the device is vulnerable to a rush current since the heater lamp is turned on with maximum input power that is usually close to rated consumption electric power thereby easily causing a break in the circuit. See Japanese Laid Open Patent No. 2002-258646.

In view of the above problems, it is an object of the present invention to provide a heater roller capable of reducing rush current at the start of power distribution.

It is another object of the present invention to provide a heater roller of a fixing device with a simple structure which is capable of reducing rush current at the start power.

A heating roller comprises a first heater lamp having a first filament made of tungsten, and a second heater lamp having a second filament, wherein the second filament is a heating element whose resistivity value is greater than that of tungsten at a room temperature.

The second heater lamp may be an auxiliary heater lamp. The auxiliary heater lamp may be turned on at an initial power distribution period.

Further, the first filament of the first heater lamp may have at least one first lighting portion and at least one first non-lighting portion, and the second filament of the second heater lamp may have at least one second lighting portion and at least one second non-lighting portion.

Furthermore, the at least one first lighting portion may face the at least one second non-lighting portion and the at least one first non-lighting portion may face the at least one second lighting portion.

DESCRIPTION OF THE DRAWINGS

The embodiments of the present invention will be described referring to FIGS. 1–6.

FIG. 1 is a diagram explaining the structure of heating roller according to the present invention;

FIG. 2 is a diagram explaining an operation of on/off switching;

FIG. 5 is a schematic view of a fixing device; and FIG. 6 is a schematic view of a heating roller.

Figure 3:
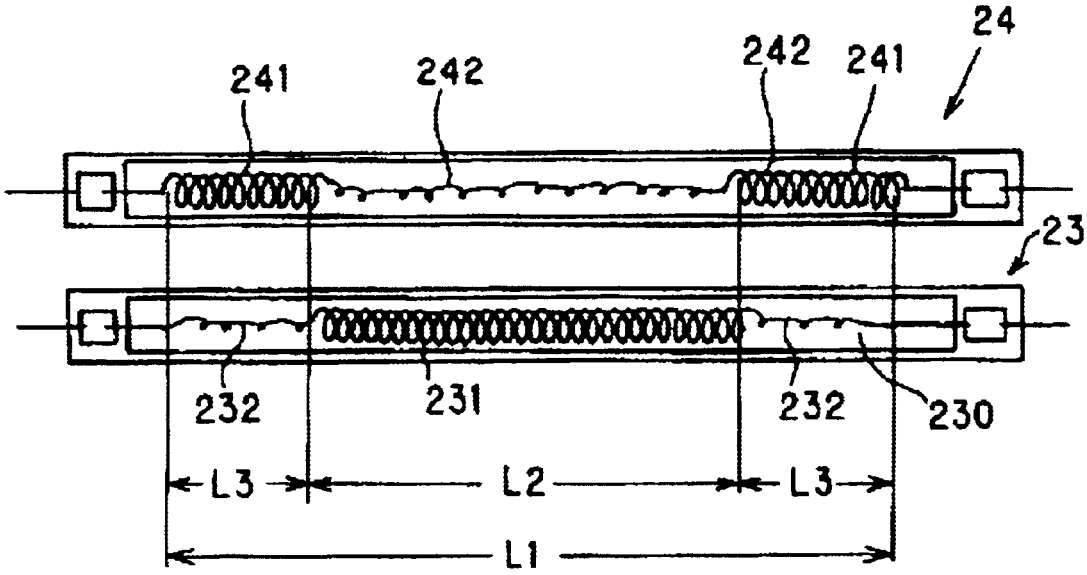
FIG. 3 is a diagram explaining the structure of heater lamp in a heater lamp according to a second embodiment.

The present invention will become more apparent from the following detailed description of the embodiments and examples of the present invention.

DETAILED DESCRIPTION OF THE INVENTION

Description of a heating roller of a first embodiment according to the present invention will be given below referring to FIG. 1.

In FIG. 1, a heating roller 1 has for example, a roller body 10, a fixing heater lamp 21 that operates as a main heating source of the roller body 10 in a fixing device at a fixing device operating time, and an auxiliary heater lamp 22 which is turned on only at an initial period of lighting, that is, time when power of the fixing device is on.

Valves 31 and 32 of the heater lamps 21 and 22are a quartz glass tube. At each end of each of the valves, a pinch seal portion is formed. Each end of a filament 210 is connected to a metallic foils 41 contained in the pinch seal via an internal lead. An outside lead 51 is connected to each of the metallic foils 41 and derived to the outside of the heating roller 1. Each end of a filament 220 is connected to a metallic foils 42 contained in the pinch seal via an internal lead. Furthermore, an outside lead 52 is connected to each of the metallic foils 42 and derived to the outside of the heating roller 1. Furthermore, each of the outside leads 51 and 52 is connected to a power supply (not shown in FIG. 1) via a lead and the like (not shown).

The filament 210 of the fixing heater lamp 21 is made of tungsten, specifically, doped tungsten in which 50 to 90 ppm potassium is doped. Necessary inactive gas and Halogen gas are included inside the valve 31.

The filament 220 of the auxiliary heater lamp 22 is a heating element whose resistivity value at room temperature is greater than that of tungsten. The inside of the valve 32 of the auxiliary heater lamp 22 may be held with vacuum or in the atmosphere, or filled with inactive gas depending on the heating element, that is, filament 220. Furthermore, it may not be necessary to form the pinch seal portions.

The "heating element having the resistivity value at the room temperature greater than that of tungsten" means a heating element having the resistivity value at the room temperature or temperature near the room temperature (25° C.±5° C.) greater than the resistivity value of tungsten (5.5(Ω·cm)(20° C.)), specifically, a heating element made of nickel-chromium alloy (hereinafter simply referred to as Nichrome), or iron-chromium-aluminium alloy (hereinafter referred to as Cantal), a tantalum heating element, a graphite heating element, a platinum heating element and the like.

Alloys containing tungsten as a main component and about a couple of percent to 50 percent of other metal such as molybdenum which is different from so-called pure tungsten or doped tungsten (made of more than 99.9% tungsten) have the resistivity value at room temperature much greater than that of tungsten (5.5(Ω·cm)(20° C.)). It depends on the percentage of molybdenum. Thus, it is possible to select a heating element made of such alloy and use it for the present invention.

Table 1 shows examples of the resistivity value at 20° C. of heating elements made of such materials. Of course, it is possible to use a heating elements other than these heating elements for the present invention if the resistivity value of thereof at room temperature (or temperature near the room temperature) is greater than that of tungsten.

TABLE 1

| Heating Element Material | Nichrome (Ni-20Cr Heating Element) | Cantal (Fe026Cr-7.5Al) Heating Element) | Tantalum (Ta) | Platinum (Pt) |
|---|---|---|---|---|
| Resistivity Value (20° C.) (μΩ · cm) | 110 | 160 | 12.5 | 10.6 |

The fixing heater lamp 21 and the auxiliary heater lamp 22 are connected in parallel to an outside power supply apparatus (not shown). It is possible to supply power to both heater lamps 21 and 22 or only to the fixing heater lamp 22 by a switching unit (not shown).

Description of a switching operation will be given referring to FIG. 2.

FIG. 2 is a timing chart to explaining the relationship between power application timing of the fixing heater lamp 21 and the auxiliary heater lamp 22. At an initial fixing device rising time, almost maximum dissipation is applied to both heater lamps 21 and 22 so as to turn on them. When the roller body 10 reaches a predetermined temperature, the heating roller 10 is ready to operate and the auxiliary heater lamp 22 is turned off thereby turning on only the fixing heater lamp 21 so that the operation is changed to a normal lighting operation.

At the initial operation period of the fixing device, almost (fixing device rising device) maximum dissipation is applied to the fixing heater lamp 21 and the auxiliary heater lamp 22 to heat the roller body 10. Since even at the initial operation period of the fixing device, the filament 220 of the auxiliary heater lamp 22 has the resistivity value at room temperature sufficiently greater than that of tungsten, it is possible to control the value of current flowing the auxiliary heater lamp to much lower than that in the conventional device thereby reducing rush current.

After the heating roller reaches the predetermined temperature so that the heating roller is warmed up, power is applied to the fixing heater lamp 21 only and power is not applied to the auxiliary heater lamp 22. At this point, the filament 210 of the fixing heater lamp 21 is sufficiently warmed up, that is, the resistivity value of the tungsten is increased so that rush current does not flow.

As described above, since an auxiliary heater lamp 22 out of a plurality of heater lamps provided inside the roller body 10 has, as a heating element, the filament 220 whose resistivity value at room temperature is greater than that of tungsten, it is possible to reduce rush current at the initial operation of the fixing device. Further, since the filament 210 of the fixing heater lamp 21 is made of tungsten, it is possible to maintain excellent heat response capability of the heater lamp while the heating roller 1 operates.

Since if the filaments of the plurality of heater lamps provided inside the roller body 10 are made of only Nichrome or Cantal, the temperature rises slowly compared with the heater lamp 21 made of tungsten, the temperature rising speed of the roller body 10 is remarkably deteriorated so that requirements for temperature rising time of the heating roller in the market cannot be met.

Specifically, although the rising time is preferably less than 30 seconds, in case of Nichrom or Cantal filaments, it takes more than 60 seconds.

Therefore, it is possible to meet the requirements of the rising time of the surface temperature of the heating roller 1 by using at least one of the heater lamps which is made of tungsten and it is possible to delicately control the surface temperature of the heating roller 1. Further, even though the heater lamps are turned on at a state where the filament temperature is low, current flowing through the circuit does not become excessive. Especially, it is preferred that the filament of a heater lamp which is turned on while the fixing device is operated is made of tungsten.

According to the above described structure of the embodiment described above, since the tungsten filament is used for the fixing heater lamp 21 and the filament 220 whose resistivity value at room temperature is greater than that of tungsten is used as a heating element for an auxiliary heater lamp 22, it is possible to prevent the problem that the rush current becomes excessive, and it is possible to provide a heating roller 1 with excellent heat response capability while the fixing device is operated.

Description of a second embodiment according to the present invention will be given below referring to FIG. 3. In FIG. 3, a roller body 10 shown in FIG. 1 is omitted and only heater lamps are shown. For the same elements as those shown in FIG. 1, in FIG. 3, the same reference numerals are used and explanation therefore is omitted.

Difference between the first and the second embodiments is that the auxiliary heater lamp 24 is also operated at time other than the temperature rising time while the fixing device is operated.

As shown in FIG. 3, a fixing heater lamp 23 and the auxiliary heater lamp 24 are provided inside the roller body 10. Both heater lamps 23 and 24 are inserted inside the roller body 10 so that the tube axes of the heater lamps 23 and 24 are parallel to the longitudinal direction of the heating roller 1.

The fixing heater lamp 23 and the auxiliary heater lamp 24 have a light emitting portion(s) and a non-light emitting portion(s). A light emitting portion 231 of a filament 230 of the fixing heater lamp 23 faces a non-light emitting portion 242 of a filament 240 of the auxiliary heater lamp 24. Lighting portions 241 of the filament 240 of the auxiliary heater lamp 24 faces non-lighting portions 232 of the filament 230 of the fixing heater lamp 23. In the fixing heater lamp 23, the filament 230 made of tungsten in which potassium is doped at about 100 ppm is provided. In the auxiliary heater lamp 24, the filament 240 which is a heating element made of, for example, Nichrome or Cantal. The heating element of the auxiliary heater lamp 24 has the resisitivity at a room temperature greater than that of tungsten.

The non-light emitting portion includes one that emits heat so that, to uniformly heat the heating cylindrical body, the heat release value per unit length from the non-light emitting portion is smaller than that from the light emitting portion. The non-light emitting portion may emit no light.

The fixing heater lamp 23 has the light emitting portion 231 corresponding to a paper sheet passing through area L2 for a predetermined size paper sheet which is smaller than a paper sheet passing through area L1 for a maximum size paper sheet. By emission of the light emitting portion 231, the paper sheet passing through area L2 for the smaller paper sheet is heated. On the other hand, the auxiliary heater lamp 24 has light emitting portions 241 in areas L3 which is located outside the paper sheet passing through area L2 for the predetermined size paper sheet and inside the largest size paper sheet passing through area L1. By emission of the light emitting portion 241, the areas L3 outside the predetermined size paper sheet passing through area L2 for a maximum size paper sheet is heated. Thus, it is possible to heat, on the heating roller 1, only area where a paper sheet passes through.

In the heating roller described above, it is preferably changed to the fixing device operating state for a short time as well as the first embodiment.

In the initial lamp lighting period, all the heater lamps are turned on by applying thereto input power equal to rated consumption electric power so as to heat the roller body 10. Since the filament 240 of the auxiliary heater lamp 24 is a heating element whose resisitivity is greater than that of tungsten, it is possible to control rush current flowing through the auxiliary heater lamp 24 even when high power is applied to all the heater lamps.

Accordingly, it is possible to reduce rush current flowing through the entire circuit thereby reducing rush current. The material of the heating element as a filament of the auxiliary heater lamp 24 is, for example, Nichrom, Cantal, Tantalum, platinum, or graphite. Of course, it is possible to use other alloys. In such a heating roller 1 having the auxiliary heater lamp 24, after the roller body 10 is sufficiently heated the auxiliary heater lamp 24 is turned on and off (a switching operation takes place) in accordance with areas L1 to L3 where the paper sheet passes through.

The fixing heater lamp 23 in which the light emitting portion 231 is provided corresponding to a paper sheet passing through area L2 for the predetermined paper sheet, is always turned on despite the size of the paper sheet so as to heat the roller body 10. The filaments of these heater lamp are made of tungsten so that it is possible to provide a heating roller 1 with high heat response capability.

EXAMPLE

A heating roller according to the second embodiment was prepared in the following specification:

Roller Body 10
- Material: Iron
- External Diameter: 35 mm
- Internal Diameter: 33 mm
- Length: 350 mm Fixing Heater Lamp 23
- Entire Length: 390 mm
- Valve Material: Quartz glass
- Valve External Diameter: 6 mm
- Valve Radial Thickness: 1 mm
- Filament Material: 50 to 90 ppm potassium doped tungsten (Tungsten: more than 99.9%)
- Filament Diameter (Wire Diameter): ϕ0.29 mm
- Length of Light Emitting Portion: (L1): 195 mm
- Applied Power: 600 W (Voltage: 100 V)

Auxiliary Heater Lamp 24
- Lamp Length: 390 mm
- Valve Material: Quartz glass
- Valve External Diameter: 6 mm
- Valve Radial Thickness: 1 mm
- Material of Filament: Cantal
- Filament Diameter (Wire Diameter): ϕ0.5 mm,
- Length of light emitting portion (L2): 335 mm
- Applied Power: 600 W (Voltage: 100 V)

Comparative Example

Except that the filament of the auxiliary heater lamp 24 was made of tungsten with the wire diameter ϕ0.29, a conventional heating roller having the same structure as that of the above embodiment was used.

Lamp Current Characteristic

The lamp current characteristics of the heating roller according to the present invention and the conventional heating roller were examined. When the temperature of the filament was about 20° C. (a room temperature) and stable, AC 600 W (100 V) power is applied, at the same time, to the heating rollers according to the present invention and the comparative example and held until the heater lamps are stabilized, and then rush current at an initial operation period and lamp current in the steady state while the lamp is turned on are measured and compared with each other.

Figure 4A:
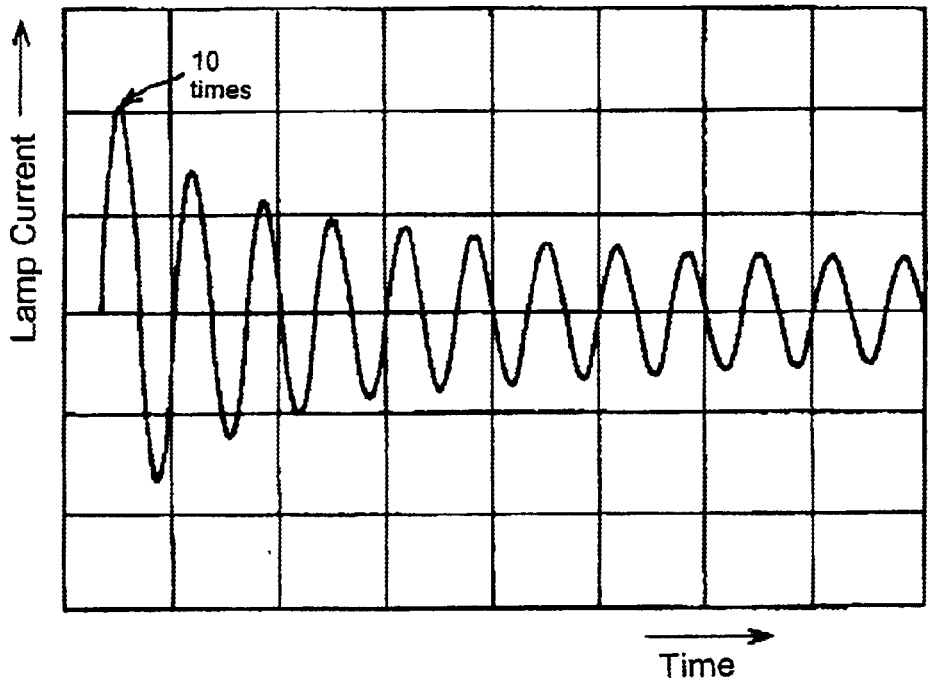
FIG. 4A shows a rising characteristic of a heating roller according to the present invention.
Figure 4B:
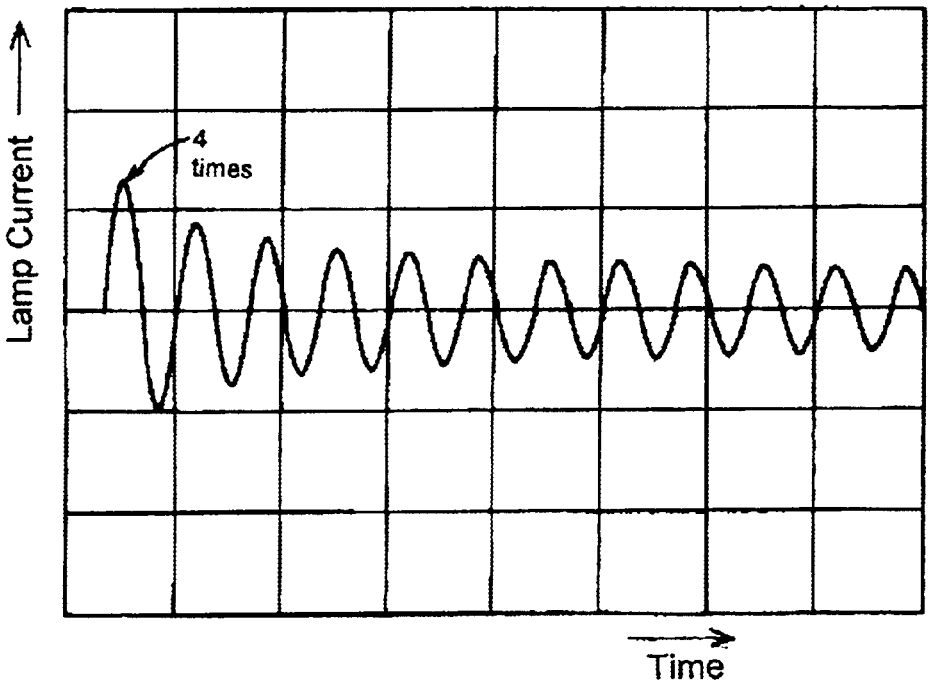
FIG. 4B shows a rising characteristic of a heating a comparative example.

FIGS. 4A and 4B show lamp current characteristic at a power applied initial period. In FIG. 4A, the lamp current characteristic of the heat roller in the comparative example is shown. FIG. 4B shows the lamp current characteristic of the heating roller according to the embodiment.

As shown in FIG. 4A, the maximum value of lamp current (the amount of rush current) at the initial lighting operation of the heating roller according to the comparative example reached 10 times the amount of the lamp current in the steady state. On the other hand, in the heating roller according to the present invention, as shown in FIG. 4B, the maximum value of lamp current (the amount of rush current) could be controlled so as to be, at the initial lighting operation, approximately 4 times the amount of lamp current in the steady state.

Rising Characteristic

In the experiment of rising characteristic of the heating rollers according to the present invention and comparative example when each of the heating rollers were turned on in the condition of AC 600 W, 100 V, it took 19 seconds for the heating roller according to the present invention to reach 160° C. which is a target outer surface temperature of the roller body, and it took 27 seconds for the heating roller according to the comparative example to reach 160° C. which is the target outer surface temperature of the roller body. The heating roller according to the present invention and the heating roller according to the comparative example sufficiently meet the demand in the market that the rising time is less than 30 seconds.

Although, as described above, as to the rising characteristic, the rising time of the heating roller according to the comparative example is shorter than that according to the present invention, in the heating roller according to the comparative example, the circuit of the comparative example can be in excess current status so that the device may be broken or flicker may occur. Therefore, judging in a comprehensive manner, it is found that the heating roller according to the present invention has advantages over the heating roller according to the comparative example, since the heating roller according to the present invention can reduce rush current without a particular circuit, breakdowns of the circuit due to excess current and flickers, and/or shorten the rising time to a certain period.

Although the embodiments according to the present invention are described above referring to the figures, it is not limited to the embodiments and possible to change them in various ways. For example, the number of the heater lamps is not limited to two (2) and may be more than three (3). In the embodiments, Cantal is used as a material of the filament of the heating roller, the heating element that has resistivity value greater than that of tungsten at a room temperature may be used thereby obtaining similar effects. That is, it is possible to reduce rush current in comparison with rush current in the steady state of lighting and also control the rising time of the heater to a certain rage demanded in the market.

Also, the structure of the heater lamp and the roller body may be changed in various ways if necessary and the structure thereof is not limited to that described above. For example, it is possible to select gas included in the valve if necessary and change the structure of the valve if necessary. Some methods for processing the surface and some materials of the filament allow to use the heating rollers in the atmosphere without forming the pinch seal portions.

As described above, according to the heating roller of the present invention, it is possible to reduce rush current at the initial power distribution period in a fixing device with a relatively simple structure.

The disclosure of Japanese Patent Application No. 2002-300150 filed on Oct. 15, 2002 including specification, drawings and claims is incorporated herein by reference in its entirety.

Although only some exemplary embodiments of this invention have been described in detail above, those skilled in the art will readily appreciated that many modifications are possible in the exemplary embodiments without materially departing from the novel teachings and advantages of this invention. Accordingly, all such modifications are intended to be included within the scope of this invention.

What is claimed is:

1. A heating roller comprising:

a first heater lamp having a first filament made of tungsten; and a second heater lamp having a second filament, wherein the second filament is a heating element whose resistivity value is greater than that of tungsten at a room temperature and the first heater lamp and the second heater lamp are connected in parallel.

2. The heating roller according to claim 1, the second heater lamp is an auxiliary heater lamp.

3. The heating roller according to claim 2, wherein the auxiliary heater lamp is turned on at an initial power distribution period.

4. The heating roller according to claim 1, wherein the first filament of the first heater lamp has at least one first lighting portion and at least one first non-lighting portion, and the second filament of the second heater lamp has at least one second lighting portion and at least one second non-lighting portion.

5. The heating roller according to claim 4, wherein the at least one first lighting portion faces the at least one second non-lighting portion and the at least one first non-lighting portion faces the at least one second lighting portion.

6. The heating roller according to claim 2, wherein the first filament of the first heater lamp has at least one first lighting portion and at least one first non-lighting portion, and the second filament of the second heater lamp has at least one second lighting portion and at least one second non-lighting portion.

7. The heating roller according to claim 6, wherein the at least one first lighting portion faces the at least one second non-lighting portion and the at least one first non-lighting portion faces the at least one second lighting portion.

8. The heating roller according to claim 3, wherein the first filament of the first heater lamp has at least one first lighting portion and at least one first non-lighting portion, and the second filament of the second heater lamp has at least one second lighting portion and at least one second non-lighting portion.

9. The heating roller according to claim 8, wherein the at least one first lighting portion faces the at least one second non-lighting portion and the at least one first non-lighting portion faces the at least one second lighting portion.

10. The heating roller according to the claim 1, wherein the first heater lamp and the second heater lamp are surrounded by a roller body.

11. The heating roller according to the claim 1, wherein the second filament is made of nickel-chromium alloy.

12. The heating roller according to the claim 1, wherein the second filament is made of iron-chromium-aluminium alloy.

13. The heating roller according to the claim 1, wherein the second filament is a tantalum heating element.

14. The heating roller according to the claim 1, wherein the second filament is a graphite heating element.

15. The heating roller according to the claim 1, wherein the second filament is a platinum heating element.

16. The heating roller according to the claim 1, wherein the second filament is made of alloys containing tungsten as a main component and approximately a couple of percent to 50 percent of other metal.

17. The heating roller according to the claim 16, wherein the other metal is molybdenum.

18. The heating roller according to claim 10, wherein the heating roller is provided in a fixing device for fixing an unfixed toner image held on a recording material.

* * * * *